United States Patent [19]

Aalto et al.

[11] Patent Number: 5,063,834

[45] Date of Patent: Nov. 12, 1991

[54] FOCUSSED VENTILATION PROCEDURE AND FOCUSSED VENTILATION MEANS

[75] Inventors: Erkki Aalto, Kausala; Teuvo Pellinen, Villähde; Jouko Eloranta, Kausala, all of Finland

[73] Assignee: Halton Oy, Finland

[21] Appl. No.: 460,898

[22] PCT Filed: Jun. 3, 1989

[86] PCT No.: PCT/FI89/00102

§ 371 Date: Feb. 9, 1990

§ 102(e) Date: Feb. 9, 1990

[87] PCT Pub. No.: WO89/11928

PCT Pub. Date: Dec. 14, 1989

[30] Foreign Application Priority Data

Jun. 10, 1988 [FI] Finland ..... 882762
Jun. 10, 1988 [FI] Finland ..... 882763

[51] Int. Cl.[5] ..... F23J 11/00
[52] U.S. Cl. ..... 98/115.1; 98/115.3
[58] Field of Search ..... 98/36, 115.1, 115.3, 98/115.4

[56] References Cited

U.S. PATENT DOCUMENTS

| | | | |
|---|---|---|---|
| 3,343,626 | 7/1968 | Braun et al. | 98/115.1 |
| 3,752,056 | 8/1973 | Chamberlin et al. | 98/115.3 |
| 4,050,368 | 9/1977 | Eakes | 98/115.3 |
| 4,268,282 | 5/1981 | Mackenzie | 98/115.1 X |

FOREIGN PATENT DOCUMENTS

| | | | |
|---|---|---|---|
| 2900575 | 7/1980 | Fed. Rep. of Germany . | |
| 34041 | 4/1981 | Japan | 98/115.1 |
| 968287 | 9/1964 | United Kingdom | 98/115.1 |
| 2061156 | 5/1981 | United Kingdom . | |

*Primary Examiner*—Harold Joyce
*Attorney, Agent, or Firm*—Steinberg & Raskin

[57] ABSTRACT

A focussed ventilation system where impure gas, or excess heat is drawn off from a source of impurities at the work space (18). The impure gas, or excess heat is moved to a collection zone located in the room space, wherefrom said impure gas, or excess heat is drawn to be treated further or conducted away from the room space.

1 Claim, 4 Drawing Sheets

FOCUSSED VENTILATION PROCEDURE AND FOCUSSED VENTILATION MEANS

BACKGROUND OF THE INVENTION

The present invention concerns a focussed ventilation method and a focussed ventilation apparatus.

Focussed ventilation methods for removing air impurities are known in the art in which separate suction is focussed directly on a work space specific source of impurities. The air containing the impurities is thus treated by being drawn either into purification and/or heat recovery. Therefore, the impurities of the work space have been arranged to be moved for treatment.

SUMMARY OF THE INVENTION

Another of the invention is a focussed ventilation method of a novel kind in which the air containing impurities is arranged to be moved off from the work space so that it will not enter the respiratory zone of the person working in said work space.

As taught by the invention, the impure air of the work space is moved away with a means comprising a blower the equivalent generating an air flow, whereby the air or gas containing impurities, or the excess heat of said work space is drawn off from the work space by means of suction provided by the blower, and in which method the air or gas is removed from the vicinity of the means, being either treated or untreated. As taught by the invention, the impure air is moved with a focussed ventilation means into a collection zone, e.g. to the vicinity of the impurity limit in the adjacency of the ceiling of the room space, and/or is mixed with the room air in order to be diluted.

In another preferred embodiment of the invention the air is moved with a focussed ventilation means directly into another room space.

The room ventilation means of the invention is mainly characterized in that in the method impure air and/or gas, and/or excess heat is/are drawn off from the source of impurities of the work space in that it will not spread into the respiratory zone of the person working in said work space, and the impure air and/or gas, and/or excess heat is/are moved to a collection zone of the impure air and/or gas, and/or excess heat located in said room space, from which zone said impure air and/or gas, and/or excess heat is/are drawn to be further treated and/or led away, and/or from where it is mixed with the rest of the air of the room space for diluting the impurities and/or the excess heat.

The focussed ventilation apparatus of the invention is mainly characterized in that the focussed ventilation apparatus comprises a body envelope or intake member and a suction aperture therein, wherethrough the vented suction can be focussed directly on the source of impurities of the work space and which apparatus comprises a blower which provides suction, an outlet duct connected to the body envelope, whereby impurities and/or excess heat are drawn with the means so that it/they will not spread into the respiratory zone of the person working at said work space, and whereby the impure air and/or gas, and or excess heat is/are transmitted into a collection zone of impurities, from which said impurities are drawn to be treated further and/or conducted off and/or from where it is/they are diluted into the room space.

BRIEF DESCRIPTION OF THE DRAWINGS

The invention is described in the following referring to certain advantageous embodiments of the invention presented in the figures of the drawings attached, but to which the invention is not intended to be exclusively confined.

DESCRIPTION OF THE PREFERRED EMBODIMENTS

Figure 1:
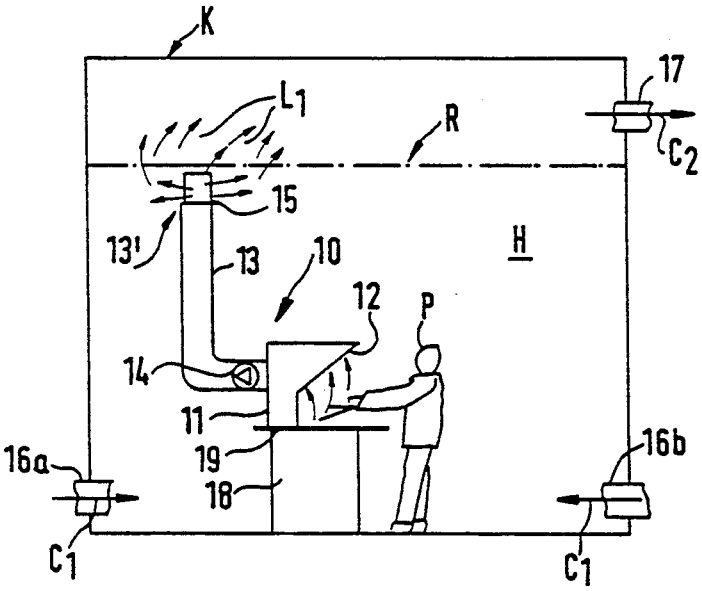
FIG. 1 presents schematically a first advantageous embodiment of the method of the invention.

In FIG. 1 is presented a first advantageous embodiment of the method of the invention. A room space H comprises a focussed ventilation apparatus 10 at a work space 18. The wide suction surface of a suction aperture 12 of the focussed ventilation apparatus 10 has been disposed above a working table 19 located in the work spot 18, positioned above e.g. a soldering site for circuit boards in said work space. The suction aperture 12 of the body envelope 11 of the focussed ventilation apparatus 10 is positioned in front of the person working at said working space so that from the work space the impurities move directly into the suction aperture 12 of the body envelope of the focussed ventilation apparatus 10 through the perforation **12*a* of a perforated plate or equivalent of the focussed ventilation apparatus 10. In the method of the invention, the focussed ventilation means 10 comprises an outlet duct 13 connected to the body 11, being rigidly joined to said body 11, and said outlet duct 13 supporting itself. A blower 14 has been disposed either directly into the outlet duct 13 or into the body envelope 11**.

The embodiment shown in FIG. 1 concerns a displacement ventilation, and fresh air is drawn into the room H into the respiratory zone and advantageously, from the vicinity of the floor L in the lower part of the room space through incoming ducts **16*a* and/or 16*b* as shown by arrows $C_1$. In displacement ventilation, the impurities of the air are not mixed with the room air but they are transmitted into the vicinity of the ceiling K of the room H and provide a layer of impure air therein. With the means 10 of the invention the air containing impurities of the work spot is carried with an air flow produced by the blower 10 directly into the vicinity of the impurity limit layer R. At the end of the outlet duct 13 of the focussed ventilation apparatus 10 is positioned a disperser 15, the function thereof being to distribute the air uniformly with a small impulse into the vicinity of the impurity limit layer, advantageously thereabove. The aim is that it will not convey the impure air above the limit layer R to below the limit layer R. Therefore, the function of the disperser is to distribute the air with a small impulse into a wide area above the limit layer R, or slightly below said limit layer wherefrom it moves above said limit layer. Furthermore, the air of the work space containing impurities and/or excess heat is removed from the room space H out through the duct 17 and/or to be purified and/or to heat recovery. The duct 17** has been disposed to be located in the vicinity of the ceiling K of the room space H. The air to be removed from the room is indicated by arrow $C_2$.

Figure 2:
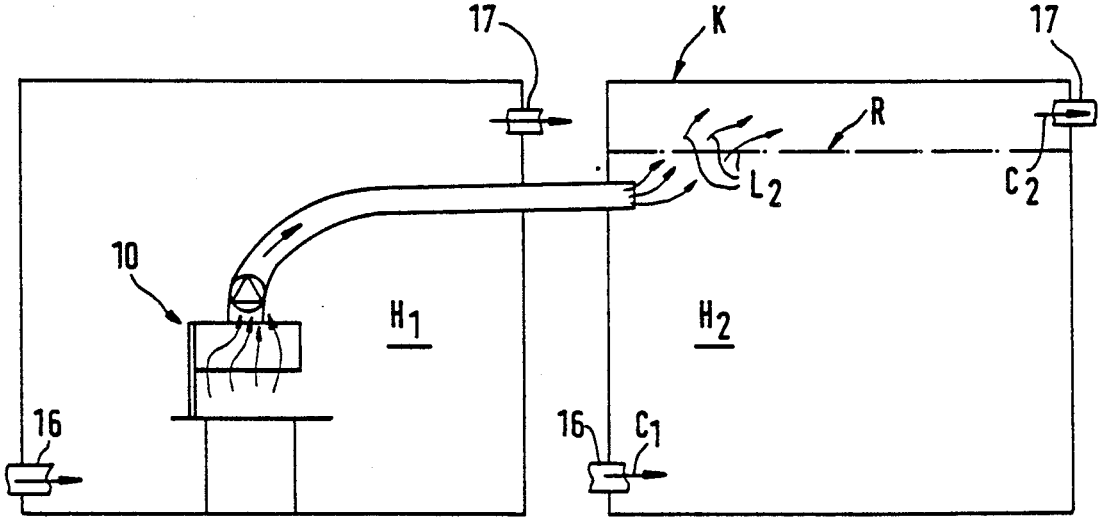
FIG. 2 presents a second advantageous embodiment of the method of the invention.

In FIG. 2 is presented a second advantageous embodiment of the method of the invention. In the method of the invention, the focussed ventilation apparatus 10 has been disposed to move the air of the work space 18 containing impurities directly from the room space $H_1$ into the collection point of impurities, being, as shown in the figure, located in another room space $H_2$. If displacement ventilation is used in the room space $H_2$, that is, fresh air is drawn into the lower part of the room space through a duct 16, and air is removed from the upper part of the room space $H_2$ through a duct 17, the impure air or gas of the work spot of the room space $H_1$ can be moved, as shown by arrow $L_2$, directly into the vicinity of the impurity limit layer R of the room space $H_2$, and advantageously above the limit layer R.

Such an embodiment is also feasible within the scope of the invention in which with the apparatus 10 of the invention the air of the room space $H_1$ is removed into another room containing mixing ventilation.

Figure 3:
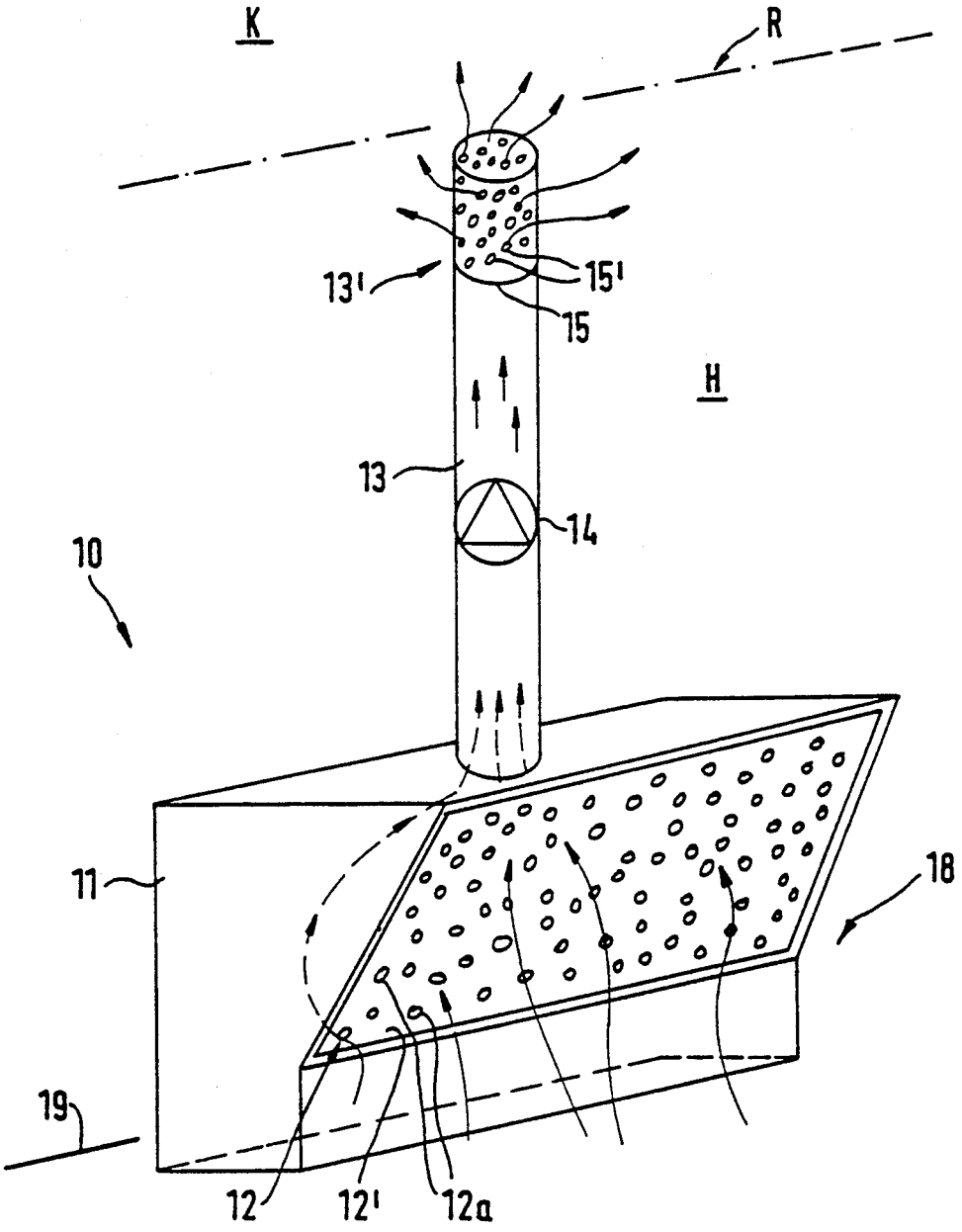
FIG. 3 presents a perspective view of the focussed ventilation apparatus used in the procedure of the invention.

In FIG. 3 is presented a third advantageous embodiment of the focussed ventilation apparatus of the invention. The focussed ventilation apparatus 10 comprises a body envelope 11 provided with a suction aperture 12 which is focussable on the target of impurities. The suction aperture 12 comprises a perforated plate 12' provided with a plurality of slots and/or holes **12*a* and/or slots or the equivalent through which the air is drawn. The apparatus comprises an outlet duct 13, advantageously a pipe made of rigid metal, coupled directly to the body envelope 11. A blower 14 generating suction has been disposed in the pipe 13**.

Also an embodiment of the apparatus of the invention is feasible in which the blower 14 is located directly inside the body envelope 11.

As shown in FIG. 3, the upper end 3' of the outlet duct 13 has been disposed to be located in the vicinity of the impurity limit layer R of the room space. As shown in FIG. 3, the end 13' of the outlet duct 13 is located above the limit layer R. The apparatus is provided with a disperser 15 shown in FIG. 3, its function being to distribute air uniformly by using a small impulse, into as wide area as possible in the impurity layer in the upper part of the room space so that said impure air will not be mixed with the rest of the air of the room space.

The outlet duct 13 supports itself, though an embodiment is also feasible in which the outlet duct 13 has been supported with separate support systems.

The disperser 15 is in one of the advantageous embodiments of the invention made of a bag of an elastic material provided with perforation 15'. Through the perforation 15' air is discharged from the end 13' of the pipe 13.

Figure 4:
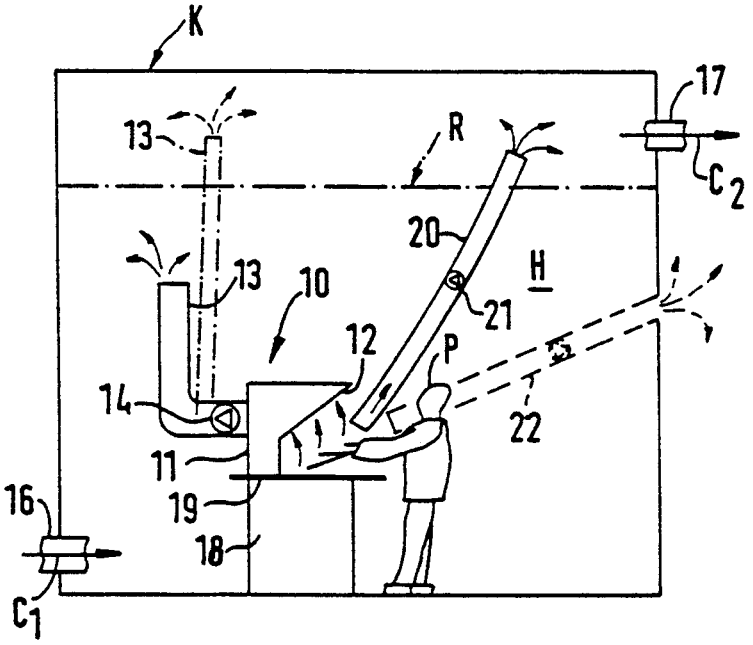
FIG. 4 presents schematically a third advantageous embodiment of the method of the invention.

In FIG. 4 is presented a third advantageous embodiment of the procedure of the invention. As shown in FIG. 4, the room space H has been provided with displacement air, that is, air is drawn into the room space, advantageously into the lower part of the room space, through a duct 16, and impure air of the room space H is removed through a duct 17 from the upper part of the room space, from above the impurity limit layer R. Air transmission into the room space is indicated by arrow $C_1$ and air removal from the room space H is indicated by arrow $C_2$. The entry of the air into the room space has been arranged to take place with a blower of its own, and the discharge of the impure air from said room space has been arranged to take place advantageously by the aid of suction provided with the blower. In the method presented in FIG. 4, the actual focussed suction is focussed on the impure air or impure gas of the work space, or at the excess heat of said work space through the actual focussed suction duct 20 with the aid of the blower 21 positioned in the duct 20. Through said duct, the majority of the impurities are removed. With the aid of an additional focussed suction, this being provided e.g. with an apparatus like the one presented in FIG. 3, the residual impurities of the work spot are removed. In the method presented in FIG. 4, the impurities and/or excess heat removed by means of the additional suction and the first focussed suction from the work space are discharged into the same room space H in which the work space is located.

In the advantageous embodiment of the invention presented in FIG. 4 the impurities and/or excess heat of the work space are moved and discharged by means of additional focussed suction through the duct 13 in the room H or equivalent provided with displacement ventilation to pass below the impurity limit layer R of the room space H, and the impurities and/or excess heat removed from the work space through the duct 20 with the actual focussed suction are discharged into the vicinity of the impurity limit layer R of the room space and advantageously, above the impurity limit layer.

In FIG. 4 is presented with a broken line an embodiment of the invention in which the impurities and/or excess heat are transferred through the duct 22 of the first focussed suction away from the room space H provided with displacement ventilation and/or said impurities and/or excess heat are transferred further into treatment, for instance into purification, and the residual impurities and/or residual excess heat of the work space drawn through the duct 13 of the additional focussed suction are discharged into the vicinity of the impurity limit layer R of the room space, or thereabove.

Figure 5:
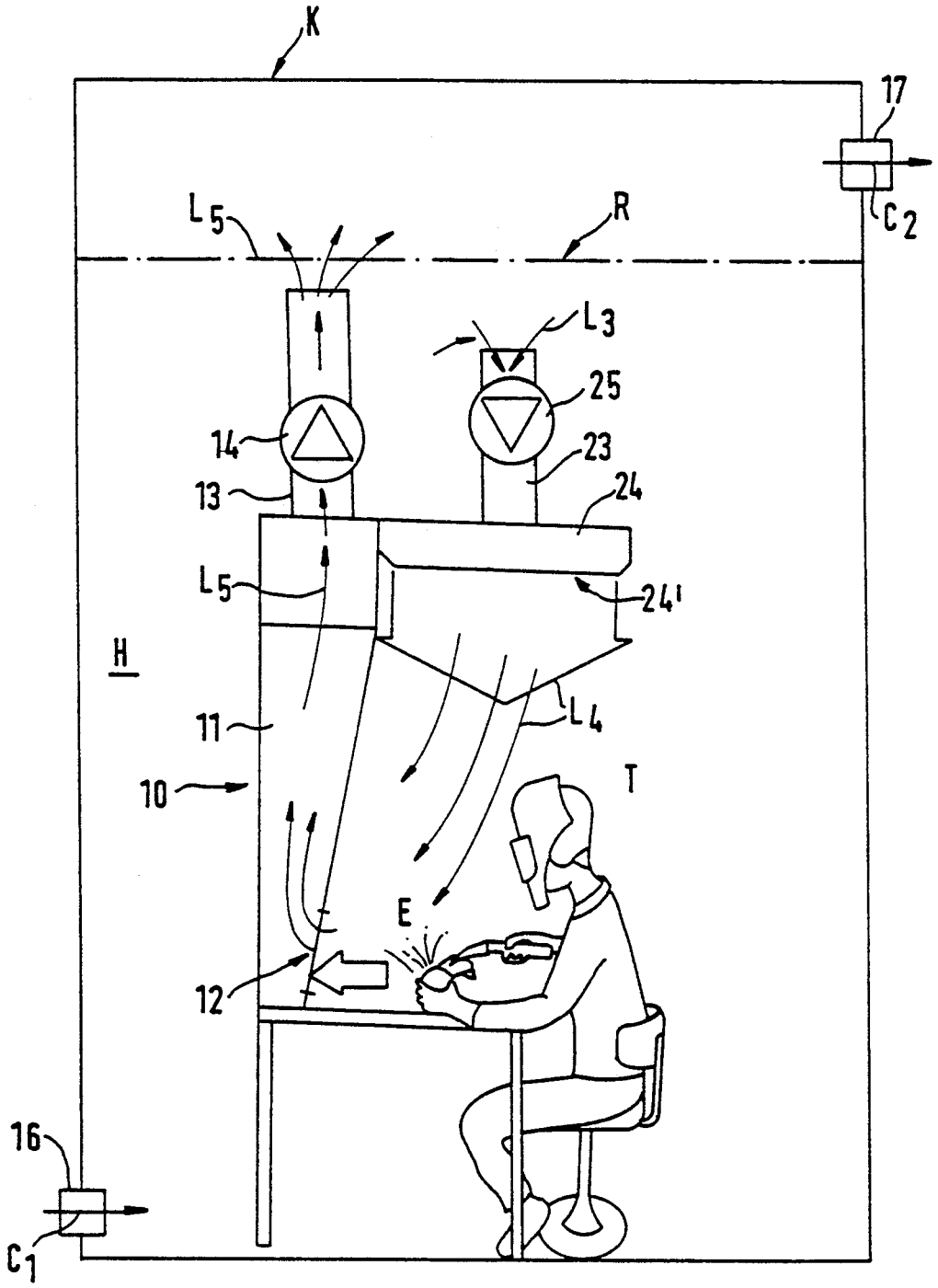
FIG. 5 presents schematically an embodiment of the procedure and the apparatus of the invention in which air is carried into the work spot and air from the work spot is removed from said work spot, and it is discharged into the same room space.

FIG. 5 presents in principle an embodiment of the method and the apparatus of the invention in which air is carried into the room space H, or respectively, as shown by arrow $C_1$, through the duct 16, advantageously from the lower part of the room space H, and air is removed from the room space H, from above the impurity limit layer R, through a duct 17, as shown by arrow $C_2$. In the room space is located a work space. In the figure is depicted a person working at the work space T. The apparatus comprises an incoming air means, comprising a duct 23 opening into said room space, a blower 25 positioned in the duct 23 with which the air of the room space H is blown and carried from the room space into the duct 23, as shown by arrow $L_3$, and furthermore into the incoming air terminal member 24 connected to the duct 23. As shown by arrow $L_4$, the air is discharged from the terminal member 24 so that it is focussed on the source of impurity E of the work space. The incoming air $L_4$ directs impure air and/or excess heat towards the focussed suction 12 of the focussed ventilation apparatus 10. The focussed ventilation apparatus 10 may be similar to the one presented in FIG. 3. The apparatus 10 comprises a body 11, a suction aperture 12, a duct 13 and a blower 14 therein. The duct 13 terminates in the room space H and it terminates in the vicinity of the limit layer R, advantageously thereabove. The discharging air of the room space H is in FIG. 5 indicated by arrow $L_5$. Therefore, in the embodiment of FIG. 5 the air of the room space H is carried with the air flow generated by the blower 25 through the duct 23 into a terminal member 24, and furthermore, through the impurity source of the work space into the discharge together with the impure air and/or excess heat. Through the means 10, said air is carried further back into the same room space and so that said impure air is discharged into the upper part of the room space, into the vicinity of the limit layer therein, or thereabove.

We claim:

1. A focussed suction ventilation apparatus comprising:

an intake member having a suction aperture therein for focussing suction therethrough on a source of impurities within a work space having a certain volume and located within a room having a larger volume;

a discharge duct connected to said intake member and extending therefrom to the vicinity of an impurity boundary layer above said work space and within said room;

a blower located within said discharge duct for providing suction therein whereby impurities drawn from said work space are conveyed through said discharge duct and discharged therefrom in the vicinity of said impurity boundary layer to collect above said impurity boundary layer, and further comprising a disperser unit mounted at the end of said discharge duct and functioning to distribute air uniformly below said impurity boundary layer so as to avoid the mixing of impure air from above said impurity boundary layer with the air from the rest of said room.

* * * * *